United States Patent [19]

Wimmer

[11] Patent Number: 4,662,666

[45] Date of Patent: May 5, 1987

[54] DOOR-BOLT SET

[76] Inventor: Hermann Wimmer, Weissenwolfgasse 80, 1210 Vienna, Austria

[21] Appl. No.: 723,795

[22] Filed: Apr. 16, 1985

[30] Foreign Application Priority Data

Jan. 2, 1985 [AT] Austria ..... 2/85

[51] Int. Cl.[4] ..... E05C 1/16

[52] U.S. Cl. ..... 292/337; 292/173; 292/DIG. 60

[58] Field of Search ..... 411/910; 292/1, 337, 292/356, 357, 223, 341.18, DIG. 60, 167

[56] References Cited

U.S. PATENT DOCUMENTS 3,179,458 4/1965 Sconzo ..... 292/341.18 X
3,859,827 1/1975 Garcia ..... 292/337 X
4,446,707 5/1984 Mullich et al. ..... 292/DIG. 60 X

FOREIGN PATENT DOCUMENTS 375722 9/1984 Austria .

*Primary Examiner*—Richard E. Moore
*Attorney, Agent, or Firm*—Karl F. Ross; Herbert Dubno

[57] ABSTRACT

A door set has a bolt-guide sleeve which is adjustably connected to the escutcheons on which the doorknobs are journaled by a pair of toothed elements bridging the escutcheons and passing through slots in the sleeves which have complementarily toothed edges.

14 Claims, 5 Drawing Figures

DOOR-BOLT SET

FIELD OF THE INVENTION

My present invention relates to a door-bolt set and, more particularly, to an assembly comprising a door bolt which is slidable in a bolt housing to engage a strike in a doorpost and is controlled by at least one doorknob for latching or unlatching a door.

BACKGROUND OF THE INVENTION

A door-bolt set or door-latch assembly can comprise a bolt which is linearly slidable in a bolt housing forming a sleeve received in a bore opening at an edge of the door and engageable in a strike plate or other recess provided on a doorpost. A doorknob, and generally a pair of doorknobs, which can be operated from opposite sides of the door, can be a rotatably mounted door-set assembly, rotatable in a pair of escutcheons fixed to the door, e.g. from opposite sides thereof, and carrying an eccentric pin which is connected, e.g. by a hook arrangement, to the bolt.

The sleeve forming the bolt housing can be connected by screws to an edge of the door from which the bolt can project. Austrian Pat. No. 375,722 discloses such a door latch.

In that patent there is described an arrangement in which a threaded member traversing the bolt is connected to the hook so that the distance between the end of the hook and the free end of the bolt can be adjusted by rotation of the screw to thereby adjust the depth to which the bolt can project into the strike plate.

This system also has the advantage that it allows various distances between the door and the doorpost to be bridged by the bolt assembly by adjusting the distance to which the bolt projects from the sleeve.

I have discovered that this arrangement has a problem in that, while the effective length of the bolt can be adjusted utilizing the system, the door-latch set is devoid of any means for correspondingly adjusting the tubular housing in which the bolt is guided.

OBJECT OF THE INVENTION

It is, therefore, the principal object of the present invention to provide an improved door-latch assembly or door set which overcomes the aforementioned disadvantage while retaining the advantages of the door set described in the aforementioned Austrian patent.

SUMMARY OF THE INVENTION

This object is attained, in accordance with the invention, by providing the bolt housing so that it is slidable with respect to the shaft support of the assembly and by also providing means for adjustably locking this housing or sleeve to the shaft support members. In this manner, the spacing between the shaft-support elements and the free end of the housing can be varied upon assembly of the door set to the door and, stated otherwise, the distance between the doorknob structure and the bore provided for it in the door, and the edge of the door from which a bolt is to project, can be readily compensated by adjusting the effective length of the housing or sleeve.

According to a feature of this invention, a pair of fastening elements can be provided to transfix the bolt housing, these elements bridging the journaling plates or escutcheons upon which the door-knobs and their shaft are mounted, these fastening elements extending transversely to the longitudinal axis of the bolt and the bolt-guide sleeve, and being provided with formations for selectively positionin these elements within slots extending parallel to the axis and formed in the bolt housing.

The formations can be mating teeth formed on the edges of the slot and on the flanks of the fastening element engageable therein.

This arrangement has been found to be simple and easily fabricated.

The axis of the fastening elements, according to a feature of the invention, can intersect the longitudinal axis of the bolt-guide sleeve and the bolt being located inwardly from the end of the latter at a location reached by the hook which anchors the bolt to the eccentric pin previously mentioned. By providing the axis of the bolt and the sleeve so that it is coplaner with the axis of the two locking elements, the positioning of the sleeve is made more accurate, i.e. the sleeve is statically fixed in proper alignment.

BRIEF DESCRIPTION OF THE DRAWINGS

The above and other objects, features and advantages of the present invention will become more readily apparent from the following description, reference being made to the accompanying drawing in which.

SPECIFIC DESCRIPTION

Figure 1:
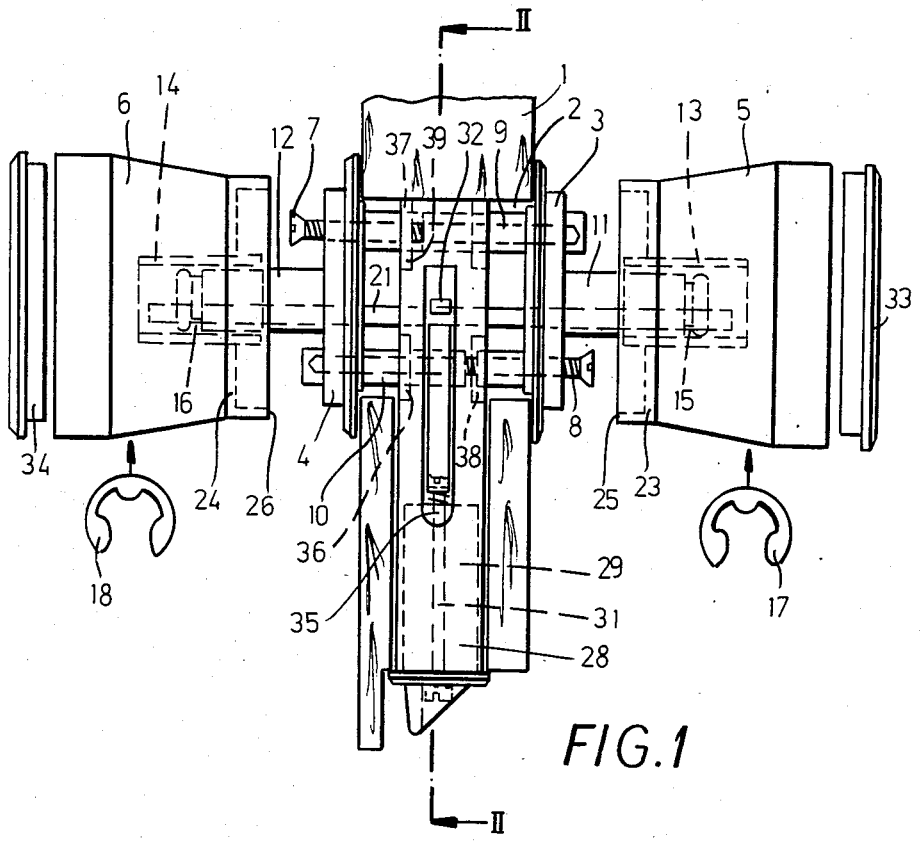
FIG. 1 is a horizontal section through a door, diagrammatically showing the door set of the invention in a plan view and partly in exploded form.

The door 1 is provided with a transverse horizontal bore 2 which receives inner rims of a pair of escutcheons 3 and 4 seated against opposite faces of the door and forming a pair of bearing plates or parts for respective doorknobs 5 and 6.

Screws 7 and 8 traversing the bore 2 clamp the two plates against the door and draw the plates toward one another.

In the embodiment illustrated and in the preferred and best mode embodiment of the invention, these screws or bolts pass through a pair of fastening elements represented at 9 and 10 and which will be discussed in greater detail hereinafter.

Consequently, not only do these bolts draw the plates together but they also hold the elements 9 and 10 fixed on these plates.

Each of the escutcheons 3, 4 is formed with a central bearing projection or boss 11, 12 on which the respective doorknob 5, 6 is mounted by a corresponding central journaling sleeve 13, 14 and onto which the doorknob can be locked against axial displacement by a respective spring clip (circlip) 17, 18 engaging in grooves 15 or 16.

Each escutcheon 3, 4 is provided with a pair of circular-arc segmental windows 19, 20 eccentric with the axis of the bearing projections 11, 12, and through which pins 21 and 22 project to operatively connect the knobs together, one of these pins corresponding to the eccentric pin previously described. In this event, no shaft is required to connect the knobs.

The bottom faces 23, 24 of the knobs 5, 6 can be recessed from the inwardly turned edges 25, 26 so that these knobs can at least partially overlap portions of the escutcheons 3 and 4 turned outwardly and cover the screws 7 and 8 which have been shown to be backed out only for clear illustration.

The sleeves 13, 14 can then project axially beyond the recessed portions in the direction of the bearing members 3, 4. The total length of the bearign sleeves 13, 14 corresponds thus to the spacing of the grooves 15 and 16 from the end face of the respective bearing plate 3 or 4.

The door is formed with another horizontal bore 27 in which a bolt housing 28 is received, this bolt housing having a flange 28' which can be affixed to the edge 1' of the door by screws 28''.

A bolt 29 is axially shiftable in this bolt-guide sleeve or housing 28 which, in its inner or rear portion, extends into the bore 2 and is traversed by the locking elements 9 and 10 which fix the housing 28 with respect to the escutcheons 3 and 4. As can be seen from the drawing clearly, the elements 9 and 10 each have generally rectangular profiles or cross sections and are formed with teeth along a pair of opposite flanks which generally extend in planes parallel to the axis of the bolt 29 and the sleeve 28 and parallel to the axis of rotation of the doorknobs.

Figure 2:
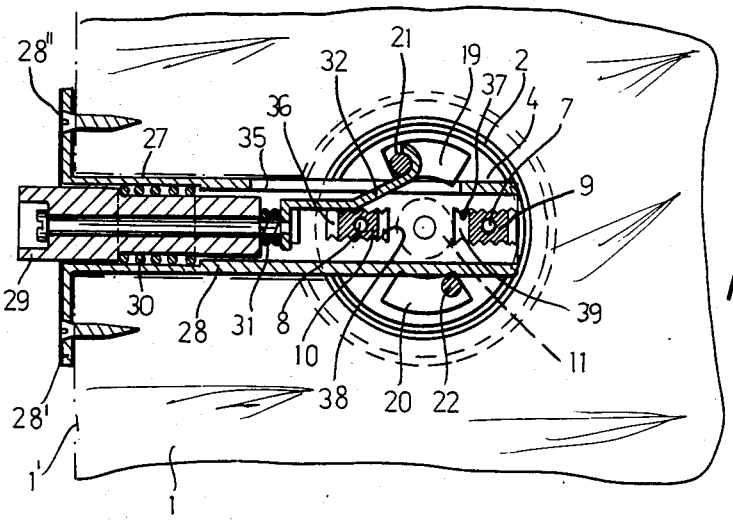
FIG. 2 is a section along the line II—II of FIG. 1.
Figure 3:
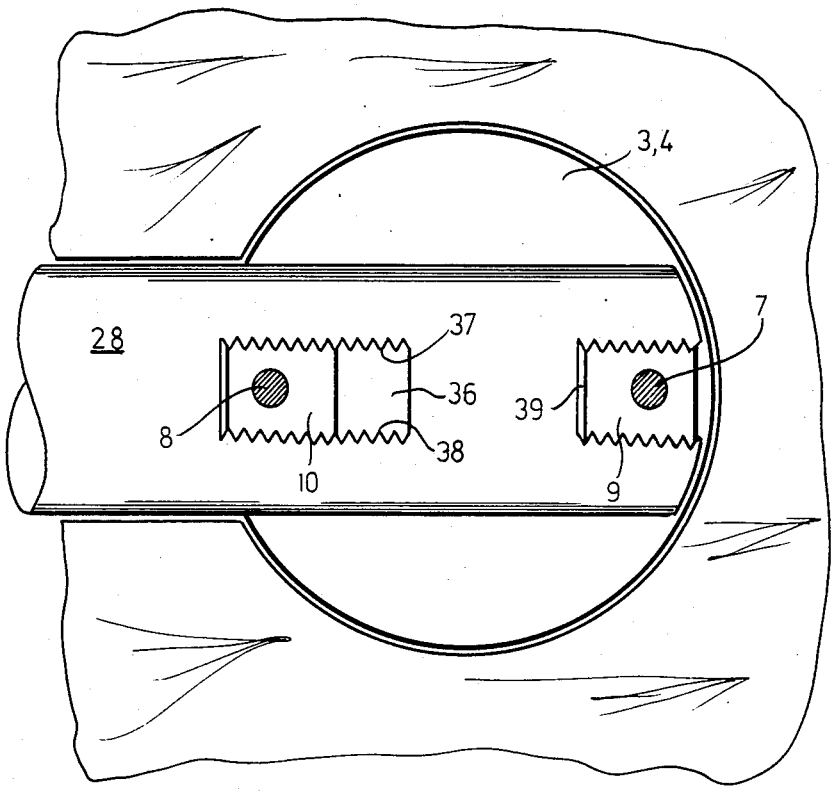
FIG. 3 is a detail view showing the locking elements of the invention in a slight modification of the shape and form from that of FIG. 2.
Figure 5:
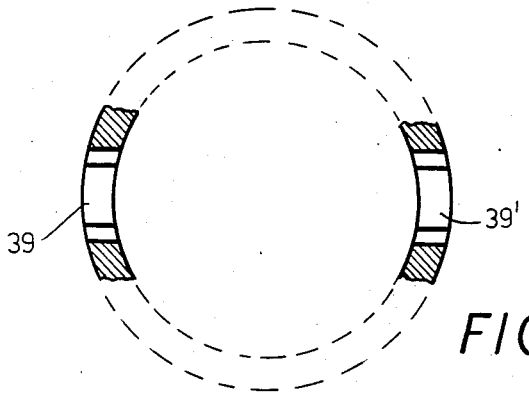
FIG. 5 is a partial section taken in a plane along the axis of one of the elements showing the aligned slots or windows through which one of the elements can project.
Figure 4:
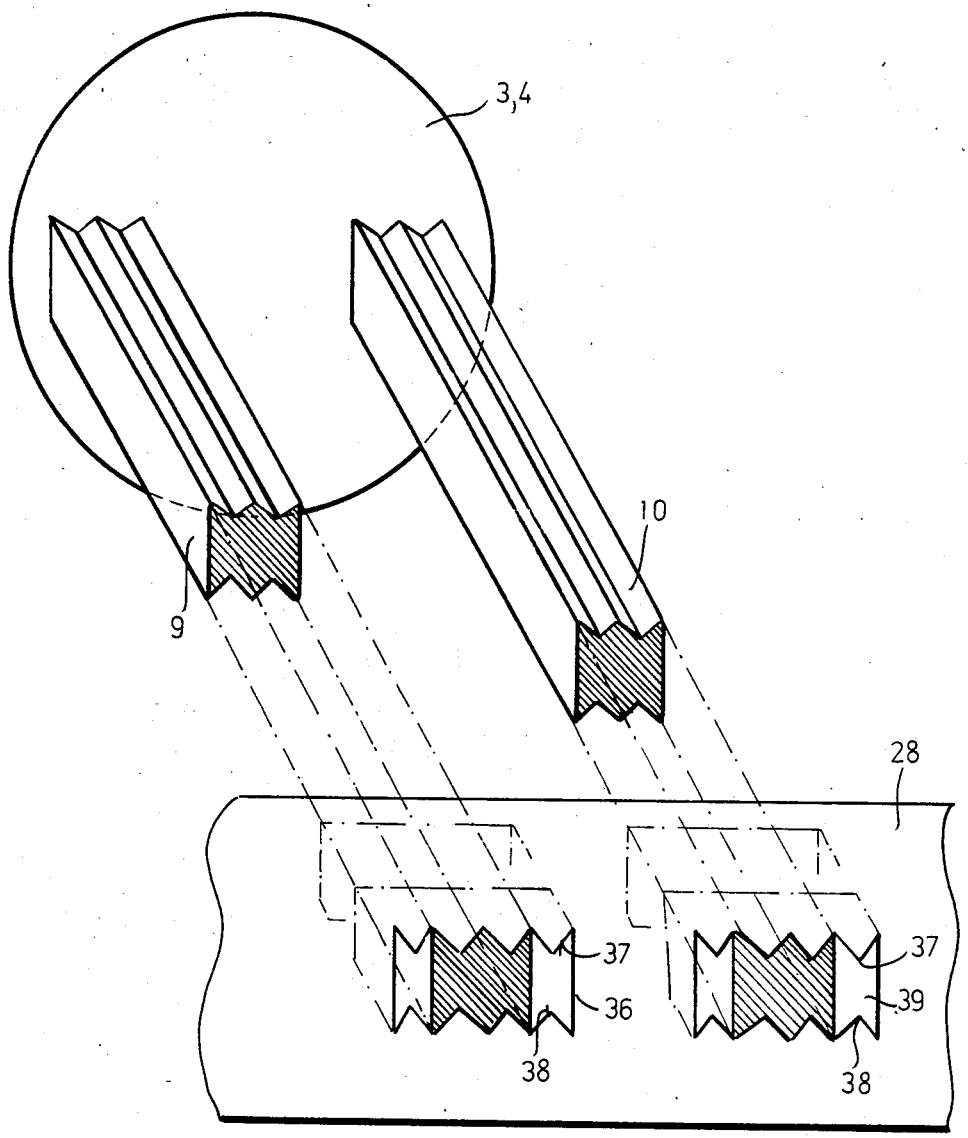
FIG. 4 is a perspective view illustrating another arrangement operating under the same principles, partly broken away and in a highly diagrammatic form.

Each of the elements 9, 10 traverses a slot 36, 39 in the bolt housing 28 and, as can be seen from FIG. 5, each slot 36, 39 is diametrically opposite another slot, e.g. slot 39 is opposite slot 39', so that each element 9, 10 passes through two such slots. These slots are elongated in the axial direction. The slots 36 and 39 are generally either open-ended (FIGS. 2 and 3) or can be closed-ended (FIG. 4) as long as the housing 28 can be shifted to the right and to the left for assembly. The edges of the slots or windows corresponding to the tooth flanks of the elements 9 and 10 are provided with complementary arrays of teeth 37, 38.

The bolt 29 is biased into its extended position by a spring 30 seated against the housing 28. At the inner end of the bolt, a self-locking screw 31 anchors a connecting hook 32 which passes through a lateral opening 35 in the bolt housing 28 and engages the pin 21 to form a crank connection between the doorknobs 5, 6 and the bolt. The screw 31 traverses the bolt 29 and from the free end thereof can be rotated to adjust the extent to which the bolt projects from the door edge. In this respect the door set operates in the manner described in the aforementioned Austrian patent, the rotation of the doorknob retracting the bolt against the force of the spring 30 and release of the doorknob permitting the spring to bias the bolt outwardly into engagement with a strike.

For mounting the door set, initially the housing 28 with the bolt 29 traversely fitted therein, is introduced into the bore 27 of the door.

The escutcheon 4 is then positioned from one side of the door in the opening 2 and the elements 9 and 10 are then threaded through the slots 36 and 39 whereupon the other escutcheon is applied and the screws 7, 8 tightened to clamp the assembly together. The doorknobs are then mounted with the pins 21 and 22 being inserted and the doorknobs are secured by rings 17 and 18. Caps 34 and 35 can then close the open ends of the doorknobs and the depth of penetration of the bolt 29 in the strike adjusted via the screw 31.

It will be apparent that the elements 9 and 10 and the cooperating teeth 37, 38 of the slots 36 and 39 not only position the bolt sleeve but also ensure proper alignment thereof with respect to the escutcheons.

I claim:

1. A door set comprising:

a bolt adapted to project from an edge of a door;

a bolt-guide sleeve slidably receiving said bolt and adapted to be mounted in a bore formed in a door;

bearing means adapted to be mounted on a door;

at least one knob journaled on said bearing means, said knob being connected to a pin eccentric to a rotary axis of said knob;

a hook connected to an inner end of said bolt and engaging said pin whereby rotation of said knob shifts said bolt in said sleeve;

at least one element fixed to said bearing means and extending through said sleeve; and means on said sleeve for the adjustable engagement of said sleeve and said element in a longitudinal direction of displacement of said bolt.

2. The door set defined in claim 1 wherein two such elements are provided and said elements lie in a common plane parallel to the direction of displacement of said bolt.

3. The door set defined in claim 2 whereig said elements have generally rectilinear cross sections and are received in respective slots formed in said sleeve.

4. The door set defined in claim 3 wherein said elements have toothed flanks engageable in complementary tooth edges of said slots, said tooth flanks lying generally in planes parallel to an axis of said sleeve and said bolt.

5. The door set defined in claim 4 wherein said elements are coplaner with said axis of said bolt.

6. The door set defined in claim 5 wherein said bearing means includes a pair of escutcheon plates interconnected by screws.

7. The door set defined in claim 6 wherein said screws traverse said elements.

8. The door set defined in claim 7 wherein each of said escutcheon plates is formed with a bearing boss defining said bearing means, a respective doorknob being journaled on each of said bosses.

9. The door set defined in claim 8 wherein said doorknobs are bridged by said pin.

10. The door set defined in claim 9 wherein said plates have respective circular segmental windows traversed by said pin.

11. The door set defined in claim 10, further comprising means on said bolt for adjusting the point at which said hook is connected to said bolt.

12. The door set defined in claim 11 wherein the last mentioned means includes a screw axially traversing said bolt defining said bearing means.

13. The door set defined in claim 12 wherein said elements are coplaner with a common axis of rotation of said knobs.

14. The door set defined in claim 4 wherein said elements are coplanar with a common axis of rotation of said knobs.

* * * * *